US005395815A

United States Patent [19]

Ikeda et al.

[11] Patent Number: 5,395,815

[45] Date of Patent: Mar. 7, 1995

[54] REVERSIBLE HEAT-SENSITIVE RECORDING MATERIAL

[75] Inventors: Mitsuhiro Ikeda; Yasuro Yokota; Shigetoshi Hiraishi; Kazuyuki Iida; Hidekazu Sano, all of Tokyo, Japan

[73] Assignee: Mitsubishi Paper Mills Limited, Tokyo, Japan

[21] Appl. No.: 74,124

[22] Filed: Jun. 8, 1993

[30] Foreign Application Priority Data

| | | | |
|---|---|---|---|
| Jun. 17, 1992 | [JP] | Japan | 04-158098 |
| Sep. 17, 1992 | [JP] | Japan | 04-247788 |
| Sep. 17, 1992 | [JP] | Japan | 04-247789 |
| Oct. 21, 1992 | [JP] | Japan | 04-282954 |
| Oct. 21, 1992 | [JP] | Japan | 04-282955 |
| Oct. 21, 1992 | [JP] | Japan | 04-282956 |
| Nov. 4, 1992 | [JP] | Japan | 04-294888 |
| Nov. 4, 1992 | [JP] | Japan | 04-294890 |
| Nov. 24, 1992 | [JP] | Japan | 04-313596 |
| Dec. 25, 1992 | [JP] | Japan | 04-347032 |

[51] Int. Cl.[6] ..... B41M 5/30

[52] U.S. Cl. ..... 503/216; 503/201; 503/225

[58] Field of Search ..... 503/216, 201, 225

[56] References Cited

FOREIGN PATENT DOCUMENTS

| | | | |
|---|---|---|---|
| 286116 | 10/1988 | European Pat. Off. | 503/216 |
| 492628 | 7/1992 | European Pat. Off. | 503/216 |
| 2135466 | 8/1984 | United Kingdom | 503/216 |

*Primary Examiner*—Pamela R. Schwartz

*Attorney, Agent, or Firm*—Cushman Darby & Cushman

[57] ABSTRACT

As a reversible heat-sensitive recording material which contains a normally colorless or palely colored electron donating dye precursor and an electron accepting compound capable of causing said dye precursor to change reversibly in color density due to the difference in cooling rate after heating, one in which images can be formed and erased with good contrast and images high in time stability can be maintained under environment of everyday life can be obtained by using a phenolic compound having at least one aliphatic hydrocarbon group of 6 or more carbon atoms as the said electron donating compound.

3 Claims, No Drawings

REVERSIBLE HEAT-SENSITIVE RECORDING MATERIAL

The present invention relates to reversible heat-sensitive recording materials in which formation of images and erasion of the images can be carried out by controlling the heat energy.

Heat-sensitive recording materials generally comprise a support and, provided thereon, a heat-sensitive recording layer mainly composed of a normally electron donating colorless or slightly colored dye precursor and an electron i accepting color developer. The dye precursor and the color developer instantaneously react upon application of heat by thermal head, thermal pen, laser beams or the like to form an image. Such heat-sensitive recording materials are disclosed in Japanese Patent Application Kokoku Nos. 43-4160, 45-14039 and the like.

In general, in the case of these heat-sensitive recording materials, when an image is once formed, it is impossible to erase the image to restore the portion to the original state. Therefore, for further recording of information, it is only possible to make recording in the portions where no image is formed. Accordingly, the area for heat-sensitive recording is limited and the information to be recorded is restricted and not all of the necessary information can be recorded.

Recently, reversible heat-sensitive recording materials capable of repeating the formation of images and the erasion of the images have been proposed for solving the above problems. For example, Japanese Patent Application Kokai Nos. 54-119377, 63-39377, 63-41186 and the like, disclose heat-sensitive recording materials comprising a matrix resin and an organic low-molecular compound dispersed in the matrix resin. However, in these recording materials, the transparency of the recording materials is reversibly changed and so the contrast between the imaged portion and the unimaged portion is insufficient.

Furthermore, according to the methods described in Japanese Patent Kokai Nos. 50-81157 and 50-105555, since the images formed by these methods change depending on the environmental temperatures, the temperature at which the image-formed state is maintained differs from the temperature at which the image-erased state is maintained and so these two states cannot be maintained for a desired period at room temperature.

Further, Japanese Patent Kokai No. 59-120492 mentions a method for maintaining the image-formed state and the image-erased state by keeping the recording material in the region of! the hysteresis temperature utilizing the hysteresis characteristics of color forming components. However, this method has the defects that a heating source and a cooling source are needed for formation and erasion of images and besides, the temperature region at which the image-formed state and the image-erased state can be maintained is limited to the region of the hysteresis temperature. Thus, this method is still not sufficient for using the materials in the temperature environment of daily life.

In addition, Japanese Patent Application Kokai Nos. 2-188293 and 2-188294 and International Patent Publication No. WO90/11898 disclose reversible heat-sensitive recording media comprising a leuco dye and a color developing and decolorizing agent which causes color formation of the leuco dye upon heating and causes erasion of the color. The color developing and decolorizing agents are amphoteric compounds having an acidic group which causes color formation of the leuco dye and a basic group which causes decolorization of the leuco dye and they preferentially cause one of the color formation action of the acidic group and the decolorization action of the basic group by controlling the heat energy, thereby to perform the color formation and decolorization. However, according to this method, it is impossible to completely exchange the color forming reaction and the decolorizing reaction from each other only by control of heat energy and since both the reactions simultaneously take place at a certain ratio, sufficient color density cannot be obtained and besides the decolorization cannot be completely performed. For this reason, a sufficiently high contrast of the image cannot be obtained. Moreover, since the decolorizing action of the basic group acts also on the color formed portion at room temperature, the density of the color formed portion inevitably decreases with time.

As explained above, according to the conventional technique, there have been no reversible heat-sensitive recording materials which can give good image contrast, can form images and erase the images and can maintain images having time stability under the daily environment.

The object of the present invention is to provide reversible heat-sensitive recording materials which can give good image contrast, can form images and erase the images and can maintain images having time stability under the daily environment.

As a result of intensive research, the inventors have attained the object by producing a reversible heat-sensitive recording material characterized in that it contains a normally colorless or slightly colored electron donating dye precursor and an electron accepting compound which causes a reversible change in color density of said dye precursor due to the difference in cooling rate after heating and said electron accepting compound is a phenolic compound having at least one aliphatic hydrocarbon group of 6 or more carbon atoms. In the reversible heat-sensitive recording material of the present invention, color formation can be carried out when the cooling rate after heating is higher and erasion can be carried out when the cooling rate after heating is lower.

The electron accepting compounds used in the present invention include, for example, those which are represented by the following formula (1), but they are unlimited.

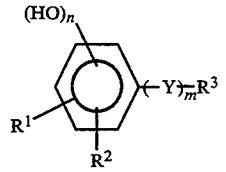

(1)

wherein n represents an integer of 1 to 3, m represents 0 or 1, $R^1$ and $R^2$ each represent a hydrogen atom or a substituent selected from an aliphatic hydrocarbon group, an alkoxy group and a halogen atom and may be identical or different, $R^3$ represents an aliphatic hydrocarbon group and Y represents a group denoted by the following formula (2).

Among the compounds represented by the formula (1), preferred are those which have the greater carbon number in the group $R^3$. When the carbon number of $R^3$ is 5 or less, the decolorizing effect is not sufficient and when the carbon number of $R^3$ is 23 or more, the production cost is high. Thus, $R^3$ is especially preferably an aliphatic hydrocarbon group of 6–22 carbon atoms.

The inventors have found that in spite of the fact that the compounds represented by the formula (1) are electron accepting compounds and have the ability to cause color formation of the leuco dye, peculiarly they also have the decolorizing effect, namely, the reversible effect. This has been utterly unexpected and such reversible effect cannot be obtained at all by the electron accepting compounds used in the ordinary heat-sensitive recording materials, such as 2,2-bis(4-hydroxyphenyl)propane, bis(4-hydroxyphenyl)sulfone and benzyl 4-hydroxybenzoate.

$$-X^1\text{-}(Ar)_p\text{-}(X^2)_q \quad (2)$$

wherein p and q each represents 0 or 1, $X^1$ and $X^2$ each represents a divalent group having at least one hetero atom and may be identical or different and Ar represents an aromatic group which may have a substituent, and the aromatic group represented by the formula (3) is especially preferred.

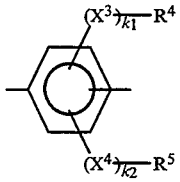

(3)

wherein $k_1$ and $k_2$ each represents an integer of 0 or 1; $X^3$ and $X^4$ each represents a divalent group having at least one hetero atom and may be identical or different; when $k_1$ is 0, $R^4$ represents a hydrogen atom or a substituent selected from an aliphatic hydrocarbon group, an alkoxy group and a halogen atom and when $k_1$ is 1, $R^4$ represents an aliphatic hydrocarbon group; and when $k_2$ is 0, $R^5$ represents a hydrogen atom or a substituent selected from an aliphatic hydrocarbon group, an alkoxy group and a halogen atom and when $k_2$ is 1, $R^5$ represents an aliphatic hydrocarbon group.

When $R^4$ and $R^5$ in the formula (3) are aliphatic hydrocarbon groups, they are especially preferably aliphatic hydrocarbon group of 6–22 carbon atoms.

Further, when $R^1$–$R^5$ in the formulas (1) and (3) are aliphatic hydrocarbon groups, they are especially preferably alkyl groups, cycloalkyl groups or alkenyl groups.

As examples of the divalent group having at least one hetero atom represented by $X^1$–$X^4$ in the formulas (2) and (3), mention may be made of amide linkage, sulfonamide linkage, ester linkage, carbonate ester linkage, ether linkage, sulfide linkage, thioester linkage, carbonyl linkage, amino linkage, urea linkage, thiourea linkage, urethane linkage and azomethine linkage. Especially preferred are amide linkage, sulfonamide linkage, sulfide linkage, urea linkage and azomethine linkage. These are not limitative.

Among the electron accepting compounds represented by the formula (1), those which are represented by the following formula (4) are especially preferred.

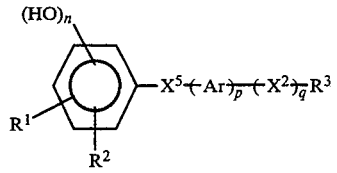

(4)

wherein n, p, q, $R^1$–$R^3$, Ar and $X^2$ are as defined above, and $X^5$ represents a linkage selected from amide linkage, sulfonamide linkage, sulfide linkage, urea linkage and azomethine linkage.

Moreover, among the compounds of the formula (4), especially preferred are amide compounds represented by the following formulas (5), (6) and (12), sulfonamide compounds represented by the following formula (7), sulfide compounds represented by the following formula (8), urea compounds represented by the following formula (9) and azomethine compounds represented by the following formulas (10) and (11). In these formulas (5)–(12), n, p, q, $R^1$–$R^3$, Ar and $X^2$ are as defined above.

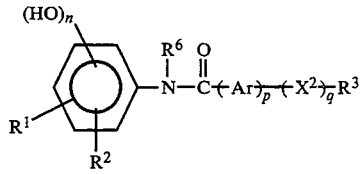

(5)

wherein $R^6$ represents an aliphatic hydrocarbon group or a hydrogen atom.

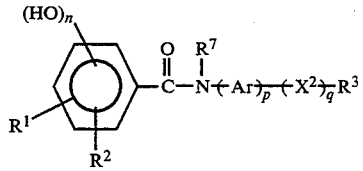

(6)

wherein $R^7$ represents an aliphatic hydrocarbon group or a hydrogen atom.

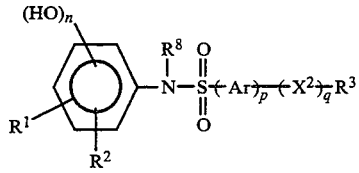

(7)

wherein $R^8$ represents an aliphatic hydrocarbon group or a hydrogen atom.

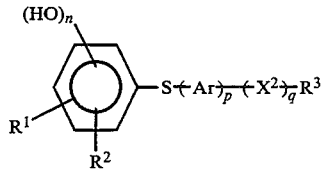

(8)

-continued

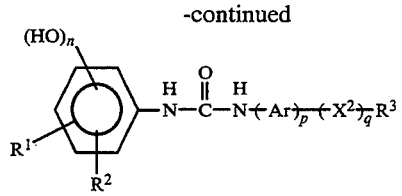

(9)

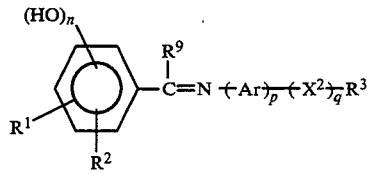

(10)

wherein $R^9$ represents an aliphatic hydrocarbon group or a hydrogen atom.

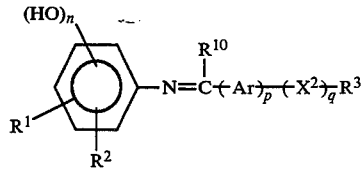

(11)

wherein $R^{10}$ represents an aliphatic hydrocarbon group or a hydrogen atom.

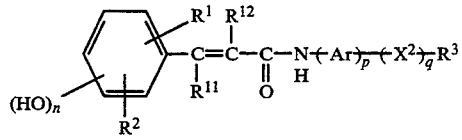

(12)

wherein $R^{11}$ and $R^{12}$ each represents a lower alkyl group or a hydrogen atom and may be identical or different.

Examples of the preferred electron accepting compounds used in the present invention are enumerated below, but these are not limitative.

As examples of the amide compounds represented by the formula (5), mention may be made of the following compounds: 4'-hydroxyheptananilide, 4'-hydroxy-3-methyloctananilide, 4'-hydroxytridecananilide, 4'-hydroxyheptadecananilide, 4'-hydroxynonadecananilide, 3'-hydroxynonadecananilide, 4'-hydroxy-10-octadecenanilide, 4'-hydroxydocasananilide, 15-cyclohexyl-4'-hydroxypentadecananilide, 4'-hydroxy-5-tetradecenanilide, 4'-hydroxy-3'-methylnonananilide, 3'-cyclohexyl-4'-hydroxyheptadecananilide, 3'-allyl-4'-hydroxypentadecananilide, 4'-hydroxy-3'-methoxyoctadecananilide, 3'-chloro-4'-hydroxyoctadecananilide, 3'-hydroxydodecananilide, 2', 4'-dihydroxyheptadecananilide, 4'-hydroxy-4-hexylbenzanilide, 4'-hydroxy-4-dodecylbenzanilide, 4'-hydroxy-4-tetradecylbenzanilide, 4'-hydroxy-4-octadecylbenzanilide, 4'-hydroxy-4-pentadecylaminocarbonylbenzanilide, 4'-hydroxy-4-hexylcarbonylaminobenzanilide, 4'-hydroxy-4-(heptylthio)benzanilide, 4'-hydroxy-4-octadecyloxybenzanilide, 4'-hydroxy-4-dodecylsulfonylbenzanilide, 4'-hydroxy-4-nonylsulfonyloxybenzanilide, 4'-hydroxy-4-dodecyloxysulfonylbenzanilide, 4'-hydroxy-4-pentadecylaminosulfonylbenzanilide, 4'-hydroxy-4-(N-pentadecylideneamino)benzanilide, 4'-hydroxy-4-(N-heptadecylideneamino)benzanilide, 4'-hydroxy-3,4-dioctyloxybenzanilide, 4'-hydroxy-3,4,5-trioctadecyloxybenzanilide, 4'-hydroxy-3-octyl-4-(octylthio)benzanilide, 4'-hydroxy-3-(heptadecylthio)-5-pentadecyloxybenzanilide, 4'-hydroxy-3-heptadecylcarbonylamino-5-dodecylbenzanilide, 4'-hydroxy-3-octadecylaminocarbonyl-5-tetradecylaminocarbonylbenzanilide, 4'-hydroxy-3-octadecylsulfonylamino-5-octadecyloxybenzanilide, 4'-hydroxy-3-heptadecyloxysulfonyl-5-tetradecyloxysulfonylbenzanilide, 4'-hydroxy-3,5-bis(N-docosylideneamino)benzanilide, 4'-hydroxy-4-octadecylcarbonylaminobenzanilide, 4'-hydroxy-3-octadecylcarbonylamino-5-octadecyloxybenzanilide, 4'-hydroxy-3'-methyl-4-nonylbenzanilide, 3'-allyl-4'-hydroxy-4-pentadecylbenzanilide, 4'-hydroxy-3'-methoxy-4-octadecylbenzanilide, 4'-hydroxy-3'-methyl-4-nonyloxybenzanilide, 4'-hydroxy-3'-propyl-4-nonadecylcarbonyloxybenzanilide, 3'-butyl-4'-hydroxy-4-octadecyloxycarbonylbenzanilide, 3'-hydroxy-4-pentadecylcarbonyloxybenzanilide, 3'-hydroxy-4-nonadecylsulfonylbenzanilide, 3', 4'-dihydroxy-4-heptadecylsulfonyloxybenzanilide, 3', 4',5'-trihydroxy-4-tetracosylaminosulfonylbenzanilide, 3', 5'-dihydroxy-4-pentacosylaminocarbonylbenzanilide, 3'-hydroxy-4-(N-dodecylideneamino)benzanilide and N-[4-(3-hydroxyphenylaminocarbonyl)benzylidene]-pentadecylamine.

As examples of the amide compounds represented by the formula (6), mention may be made of the following compounds: N-cyclohexyl-4-hydroxybenzamide, N-cyclohexylmethyl-4-hydroxybenzamide, N-octyl-4-hydroxybenzamide, N-dodecyl-4-hydroxybenzamide, N-octadecyl-4-hydroxybenzamide, N-methyl-N-octadecyl-4-hydroxybenzamide, N-octacosyl-4-hydroxybenzamide, N-(3-methylhexyl)-4-hydroxybenzamide, N-(8-octadecenyl)-4-hydroxybenzamide, 4-hydroxy-4'-dodecylbenzanilide, 4-hydroxy-4'-tetradecylbenzanilide, N-methyl-4-hydroxy-4'-octadecylbenzanilide, 4-hydroxy-4'-octyloxybenzanilide, 4-hydroxy-4'-octadecyloxybenzanilide, 4-hydroxy-4'-(octadecylthio)benzanilide, 4-hydroxy-4'-pentylcarbonylbenzanilide, 4-hydroxy-4'-hexadecylcarbonylbenzanilide, 4-hydroxy-4'-heptadecyloxycarbonyloxybenzanilide, 4-hydroxy-4'-dodecyloxycarbonylbenzanilide, 4-hydroxy-4'-docosyloxycarbonylbenzanilide, 4-hydroxy-4'-heptadecylcarbonyloxybenzanilide, 4-hydroxy-4'-cyclohexylaminobenzanilide, 4-hydroxy-4'-octylaminobenzanilide, 4-hydroxy-4'-octadecylaminobenzanilide, 4-hydroxy-4'-heptylcarbonylaminobenzanilide, 4-hydroxy-4'-heptadecylcarbonylaminobenzanilide, 4-hydroxy-4'-octadecylaminocarbonylbenzanilide, 4-hydroxy-4'-(8-octadecenyl)aminocarbonylbenzanilide, 4-hydroxy-4'-dodecylsulfonylbenzanilide, 4-hydroxy-4'-octyloxysulfonylbenzanilide, 4-hydroxy-4'-octadecyloxysulfonylbenzanilide, 4-hydroxy-4'-dodecylsulfonyloxybenzanilide, N-4-hydroxybenzoyl-N'-octadecylidene-1,4-phenylenediamine, N-4-(4-hydroxyphenylcarbonylamino)benzylidenedodecylamine, 4-hydroxy-4'-octyloxycarbonylaminobenzanilide, 4-hydroxy-4'-tetradecyloxycarbonylaminobenzanilide, 4-hydroxy-4'-octadecylureylenebenzanilide, N-dodecyl-3-hydroxybenzamide, N-octadecyl-3,4-dihydroxybenzamide, N-octadecyl-2,3,4-trihydroxybenzamide, 3-hydroxy-4'-dodecyloxybenzanilide, N-methyl-4-hydroxy-3'-octadecyloxybenzanilide, 3-hydroxy-4'-octylbenzanilide, 3-hydroxy-4'-tetradecylbenzanilide, N-methyl-3-hydroxy-4'-octadecylbenzanilide, N-dodecyl-4-hydroxy-3-methylbenzamide, 3-methoxy-4-hydroxy-4'- octadecyloxybenzanilide, 3-allyl-4-hydroxy-4'-octadecyloxybenzanilide, 3-chloro-4-hydroxy-4'-octadecylbenzanilide, N-octadecyl-4-hydroxy2,5-dimethylbenzamide, N-octadecyl-4-hydroxy-3-ethylbenzamide, 4-hydroxy-4'-octyloxy-3'-methylbenzanilide, 4-hydroxy-4'-octadecyloxy-3'-chlorobenzanilide, 4-hydroxy-3', 4'-didecyloxybenzanilide, 4-hydroxy-3'-octadecylamino-4'-octadecyloxybenzanilide, 4-hydroxy-2'-chloro-3', 5'-didecyloxybenzanilide, 4-hydroxy-3', 4'-dioctadecyloxybenzanilide, 4-hydroxy-4'-octyl-3'-methylbenzanilide, 3-hydroxy-4-methyl-4'-tetradecylbenzanilide and N-methyl-4-hydroxy-3'-octadecylbenzanilide.

As examples of the sulfonamide compounds represented by the formula (7), mention may be made of the following compounds: 4-(N-octylsulfonylamino)-phenol, 4-(N-dodecylsulfonylamino)phenol, 4-(N-octadecylsulfonylamino)phenol, 4-(N-methyl-N-octadecylsulfonylamino)phenol, 4-(N-3-methylhexylsulfonylamino)phenol, 4'-hydroxy-4-cyclohexylbenzenesulfonanilide, 4'-hydroxy-4-octylbenzenesulfonanilide, 4'-hydroxy-4-dodecylbenzenesulfonanilide, 4'-hydroxy-4-dodecyloxybenzenesulfonanilide, 4'-hydroxy-4-octadecyloxybenzenesulfonanilide, 4'-hydroxy-4-(dodecylthio)benzenesulfonanilide, 4'-hydroxy-4-hexylcarbonylbenzenesulfonanilide, 4'-hydroxy-4-hexadecylcarbonylbenzenesulfonanilide, 4'-hydroxy-4-(8-heptadecenyl)carbonylbenzenesulfonanilide, 4'-hydroxy-4-octyloxycarbonyloxybenzenesulfonanilide, 4'-hydroxy-4-dodecyloxycarbonylbenzenesulfonanilide, 4'-hydroxy-4-octacosyloxycarbonylbenzenesulfonanilide, 4'-hydroxy-4-dodecylcarbonyloxybenzenesulfonanilide, 4'-hydroxy-4-hexylaminobenzenesulfonanilide, 4'-hydroxy-4-octadecylaminobenzenesulfonanilide, 4'-hydroxy-4-heptadecylcarbonylaminobenzenesulfonanilide, 4'-hydroxy-4-dodecylaminocarbonylbenzenesulfonanilide, 4'-hydroxy-4-dodecylsulfonylbenzenesulfonanilide, 4'-hydroxy-4-octyloxysulfonylbenzenesulfonanilide, 4'-hydroxy-4-octadecyloxysulfonylbenzenesulfonanilide, 4'-hydroxy-4-dodecylsulfonyloxybenzenesulfonanilide, N-octylidene-4-(4-hydroxyphenyl-)aminosulfonylaniline, N-dodecylidene-4-(4-hydroxyphenyl)aminosulfonylaniline, N-4-(4-hydroxyphenylaminosulfonyl)benzylideneoctadecylamine, 4'-hydroxy-4-octyloxycarbonylaminobenzenesulfonanilide, 4'-hydroxy-4-octadecylcarboniylaminobenzenesulfonanilide, 4'-hydroxy-4-octadecylureylenebenzenesulfonanilide, 3-(N-dodecylsulfonylamino)phenol, 4-(N-octadecylsulfonamino)catechol, 4-(N-octadecylsulfonamino)resorcinol, 4-(N-octadecylsulfonylamino)-pyrogallol, 4'-hydroxy-3-octyloxybenzenesulfonanilide, 3'-hydroxy-4-dodecyloxybenzenesulfonanilide, N-methyl-4'-hydroxy-3-octadecyloxybenzenesulfonanilide, 3'-hydroxy-4-dodecylbenzenesulfonanilide, 3-methyl-4-(N-dodecylsulfonamino)phenol, 4-methyl-3-(N-tetradecylsulfonamino)phenol, 3'-methoxy-4'-hydroxy-4-octadecyloxybenzenesulfonanilide, 3'-chloro-4'-hydroxy-4-octadecylbenzenesulfonanilide, 4'-hydroxy-2,5-dimethyl-4-octadecylbenzenesulfonanilide, 3-methyl-4-(N-octadecylsulfonamino)phenol, and 4'-hydroxy-3,4-dioctadecyloxybenzenesulfonanilide.

As the sulfide compounds represented by the formula (8), mention may be made of the following compounds: 1-(4-hydroxyphenylthio)hexane, 1-(4-hydroxyphenylthio)dodecane, 1-(4-hydroxyphenylthio)octadecane, 1-(3-hydroxyphenylthio)octadecane, 1-(4-hydroxyphenylthio)docosane, 1-(4-hydroxyphenylthio)tetracosane, 2-heptyl-1-(4-hydroxyphenylthio)octane, 1-(4-hydroxyphenylthio)-9-octadecene, 1-(4-hydroxy-3-methylphenylthio)octadecane, 1-(3-allyl-4-hydroxyphenylthio)hexadecane, 1-[4-hydroxy-3-(1,1-dimethylethyl)phenylthio]tetracosane, 1-(4-hydroxy-3-methoxyphenylthio)octadecane, 1-(2-ethoxy-4-hydroxyphenylthio)octadecane, 1-(3-chloro-4-hydroxyphenylthio)octadecane, 1-(2-fluoro-4-hydroxyphenylthio)octadecane, 1-(2-hydroxyphenylthio)octane, 1-(3-hydroxyphenylthio)octadecane, 1-3,4-dihydroxyphenylthio)octadecane, 1-(3,4-dihydroxyphenylthio)-icosane, 4'-hydroxy-4-hexyldiphenyl sulfide, 4'-hydroxy-4-dodecyldiphenyl sulfide, 4'-hydroxy-4-tetradecyldiphenyl sulfide, 4'-hydroxy-4-octadecyldiphenyl sulfide, 4'-hydroxy-4-octadecylcarbonylaminodiphenyl sulfide, 4'-hydroxy-4-dodecylxydiphenyl sulfide, 4'-hydroxy-4-octadecyloxydiphenyl sulfide, 4'-hydroxy-4-dodecylsulfonyldiphenyl sulfide, 4'-hydroxy-4-octadecyloxysulfonyldiphenyl sulfide, 4'-hydroxy-4-octadecylsulfonylaminodiphenyl sulfide, 4'-hydroxy-4-tridecylcarbonyldiphenyl sulfide, 4'-hydroxy-4-(N-heptadecylideneamino)diphenyl sulfide, 4'-hydroxy-3,4-didecyloxydiphenyl sulfide, 4'-hydroxy-3,4-dioctadecyloxydiphenyl sulfide, 4'-hydroxy-3-octyl-4-(octylthio)diphenyl sulfide, 4'-hydroxy-3-octadecyl-5-tridecylsulfonyldiphenyl sulfide, 4'-hydroxy-3-(heptadecyl)-5-pentadecyloxydiphenyl sulfide, 4'-hydroxy-3-heptadecylcarbonylamino-5-dodecyldiphenyl sulfide, 4'-hydroxy-3-octadecylcarbonylamino-5-octadecyloxydiphenyl sulfide, 4'-hydroxy-3-heptadecyloxysulfonyl-5-tetradecyloxysulfonyldiphenyl sulfide, 4'-hydroxy-3,5-bis(N-docosylideneamino)diphenyl sulfide, 4-(15-cyclohexylpentadecyl)-4'-hydroxydiphenyl sulfide, 4'-hydroxy-4-(5-tetradecenyl)diphenyl sulfide, 4'-hydroxy-4-(10-octadecenyloxycarbonyl)diphenyl sulfide, 4'-hydroxy-3'-methyl-4-nonyldiphenyl sulfide, 3'-allyl-4'-hydroxy-4-pentadecyldiphenyl sulfide, 3'-chloro-4'-hydroxy-4-octadecyldiphenyl sulfide, 3'-chloro-4'-hydroxy-4-octadecyl-5-pentadecyloxydiphenyl sulfide, 4'-hydroxy-3'-methyl-4-nonyloxydiphenyl sulfide, 4'-hydroxy-3'-(1-methylethyl)-4-pentacosylsulfonylaminodiphenyl sulfide, 4'-hydroxy-3'-(2-methylpropyl)-4-nonadecyloxysulfonyldiphenyl sulfide, 3'-hydroxy-4-dodecyldiphenyl sulfide, 3'-hydroxy-4-octadecyldiphenyl sulfide, 2', 4'-dihydroxy-4-heptadecyldiphenyl sulfide, 3', 4'-dihydroxy-4-heptadecyldiphenyl sulfide and 3'-hydroxy-4-dodecyloxycarbonyldiphenyl sulfide.

As the urea compounds represented by the formula (9), mention may be made of the following compounds: N-(4-hydroxyphenyl)-N'-hexylurea, N-(4-hydroxyphenyl)-N'-octylurea, N-(4-hydroxyphenyl)-N'-dodecylurea, N-(4-hydroxyphenyl)-N'-octadecylurea, N-(4-hydroxyphenyl)-N'-docosylurea, N-(4-hydroxyphenyl)-N'-(2-heptyloctyl)urea, N-(4-hydroxyphenyl)-N'-(14-cyclohexyltetradecyl)urea, N-(3-methyl-4-hydroxyphenyl)-N'-octadecylurea, N-(4-hydroxyphenyl)-N'-(9-octadecenyl)urea, N-(3-allyl-4-hydroxyphenyl)-N'-octadecylurea, N[3-(1,1-dimethylethyl)-4-hydroxyphenyl]-N'-octadecylurea, N-(3,5-dimethyl-4-hydroxyphenyl)-N'-octadecylurea, N-(2-hydroxyphenyl)-N'-octylurea, N-(3-hydroxyphenyl)-N'-octadecylurea, N-3,4-dihydroxyphenyl)-N'-octadecylurea, N-(3,4,5-trihydroxyphenyl)-N'-tricosylurea, N-(4-hydroxyphenyl)-N'-(4-tetradecylphenyl)urea, N-(4-hydroxyphenyl)-N'-(4-hexylphenyl-)urea and N-(4-hydroxyphenyl)-N'-(3,4-dioctadecyphenyl)urea.

As examples of the azomethine compounds represented by the formula (10), mention may be made of the following compounds: N-(4-hydroxybenzylidene)-dodecylamine, N-(4-hydroxybenzylidene)octadecylamine, N-(4-hydroxybenzylidene)-4'-hexylaniline, N-(4-hydroxybenzylidene)-4'-octylaniline, N-(4-hydroxybenzylidene)-4'-tetradecylaniline, N-(4-hydroxybenzylidene)-4'-dodecyloxyaniline, N-(4-hydroxybenzylidene)-4'-octadecyloxylaniline, N-(4-hydroxybenzylidene)-4'-(octylthio)aniline, N-(4-hydroxybenzylidene)-4'-hexadecylcarbonylaniline, N-(4-hydroxybenzylidene)-4'-octyloxycarbonylaniline, N-(4-hydroxybenzylidene)-4'-octadecyloxycarbonylaniline, N-(4-hydroxybenzylidene)-4'-dodecylccarbonyloxyaniline, N-(4-hydroxybenzylidene)-4'-tetradecylcarbonyloxyaniline, N-(4-hydroxybenzylidene)-4'-octadecyloxycarbonyloxyaniline, N-(4-hydroxybenzylidene)-4'-cyclohexylaminoaniline, N-(4-hydroxybenzylidene)-4'-dodecylaminoaniline, N-(4-hydroxybenzylidene)-4'-heptadecylcarbonylaminoaniline, N-(4-hydroxybenzylidene)-4'-dodecylaminocarbonylaniline, N-(4-hydroxybenzylidene)-4'-octadecylaminocarbonylaniline, N-(4-hydroxybenzylidene)-4'-dodecylsulfinylaniline, N-(4-hydroxybenzylidene)-4'-dodecylsulfonylaniline, N-(4-hydroxybenzylidene)-4'-octadecylsulfonylaniline, N-(4-hydroxybenzylidene)-4'-octyloxysulfonylaniline, N-(4-hydroxybenzylidene)-4'-octacosyloxysulfonylaniline, N-(4-hydroxybenzylidene)-4'-(3-methylhexyl)oxysulfonylaniline, N-(4-hydroxybenzylidene)-4'-dodecylsulfonyloxyaniline, N-(4-hydroxybenzylidene)-4'-(octylthiocarbonyl)aniline, N-(4-hydroxybenzylidene)-4'-octyloxycarbonylaminoaniline, N-(4-hydroxybenzylidene)-4'-octadecyloxycarbonylaminoaniline, N-(4-hydroxybenzylidene)-4'-octadecylureyleneaniline, N-(3-hydroxybenzylidene)dodecylamine, N-(3,4-dihydroxybenzylidene)octadecylamine, N-(2,4-dihydroxybenzylidene)octadecylamine, N-(3,4,5-trihydroxybenzylidene)octadecylamine, N-(4-hydroxy-3-methylbenzylidene)dodecylamine, N-(3-hydroxy-4-methylbenzylidene)dodecylamine, N-(4-hydroxy-$\alpha$-methylbenzylidene-4'-dodecylaniline, N-( 4-hydroxy-4-$\alpha$-methylbenzylidene)-4'-octadecylaniline and N-(4-hydroxy-3-methoxybenzylidene)dodecylamine.

As examples of the azomethine compounds represented by the formula (11), mention may be made of the following compounds: N-octylidene-4-hydroxyaniline, N-tetradecylidene-4-hydroxyaniline, N-octadecylidene-4-hydroxyaniline, N-(4-dodecyl)benzylidene-4'-hydroxyaniline, N-(4-octyloxy)benzylidene-4'-hydroxyaniline, N-(4-octadecyloxy)benzylidene-4'-hydroxyaniline, N-(4-octadecylthio)benzylidene-4'-hydroxyaniline, N-(4-undecylcarbonyl)benzylidene-4'-hydroxyaniline, N-(4-tridecylcarbonyl)benzylidene-4'-hydroxyaniline, N-(4-heptadecylcarbonyl)benzylidene-4'-hydroxyaniline, N-{4-(8-heptadecenylcarbonyl)benzylidene}-4'-hydroxyaniline, N-(4-dodecyloxycarbonyl)benzylidene-4'-hydroxyaniline, N-(4-octadecyloxycarbonyl)benzylidene-4'-hydroxyaniline, N-(4-octylcarbonyloxy)benzylidene-4'-hydroxyaniline, N-(4-octadecylcarbonyloxy)benzylidene-4'-hydroxyaniline, N-(4-hexylamino)benzylidene-4'-hydroxyaniline, N-(4-octadecylamino)benzylidene-4'-hydroxyaniline, N-(4-octadecylcarbonylamino)benzylidene-4'-hydroxyaniline, N-(4-dodecylaminocarbonyl)benzylidene-4'-hydroxyaniline, N-(4-octadecylaminocarbonyl)benzylidene-4'-hydroxyaniline, N-(4-dodecylsulfinyl)benzylidene-4'-hydroxyaniline, N-(4-octylsulfonyl)benzylidene-4'-hydroxyaniline, N-(4-dodecylsulfonyl)benzylidene-4'-hydroxyaniline, N-(4-octylsulfonyloxy)benzylidene-4'-hydroxyaniline, N-(4-dodecylsulfonyloxy)benzylidene-4'-hydroxyaniline, N-(4-dodecyloxysulfonyl)benzylidene-4'-hydroxyaniline, N-(4-octadecyloxysulfonyl)benzylidene-4'-hydroxyaniline, N-(4-octylthiocarbonyl)benzylidene-4'-hydroxyaniline, N-(4-dodecyloxycarbonylamino)-benzylidene-4'-hydroxyaniline, N-(4-octadecyloxycarbonylamino)benzylidene-4'-hydroxyaniline, N-(4-octadecylureylene)benzylidene-4'-hydroxyaniline, N-dodecylidene-3-hydroxyaniline, N-octadecylidene-3,4 -dihydroxyaniline, N-octadecylidene-3,4,5-trihydroxyaniline, N-(4-octadecyl)benzylidene-3', 4'-dihydroxyaniline, N-(4-tetradecyl)benzylidene-3'-methyl-4'-hydroxyaniline, N-(4-tetradecyl-3,5-dimethyl)-benzylidene-4'-hydroxyaniline, N-(4-tetradecyl)-benzylidene-2'-chloro-4'-hydroxyaniline and N-(4-octadecyl-3-methyl)benzylidene-3', 4'-dihydroxyaniline.

As examples of the compounds represented by the formula (12), mention may be made of the following compounds: N-hexyl-p-hydroxycinnamamide, N-cyclohexyl-p-hydroxycinnamamide, N-dodecyl-p-hydroxycinnamamide, N-octadecyl-p-hydroxycinnamamide, N-octacosyl-p-hydroxycinnamamide, N-(2-ethylhexyl)-p-hydroxycinnamamide, N-(8-octadecenyl)-p-hydroxycinnamamide, N-octyl-o-hydroxycinnamamide, N-dodecyl-m-hydroxycinnamamide, N-octa-decyl-m-hydroxycinnamamide, N-octyl-2,4-dihydroxycinnamamide, N-tetradecyl-3,4-dihydroxycinnamamide, N-octyl-p-hydroxy-$\alpha$-methylcinnamamide, N-tetradecyl-p-hydroxy-$\beta$-methylcinnamamide, N-octadecyl-p-hydroxy-$\alpha$-methyl-cinnamamide, N-(p-hexylphenyl)-p-hydroxycinnamamide, N-(p-cyclohexylphenyl)-p-hydroxycinnamamide, N-(p-dodecylphenyl)-p-hydroxycinnamamide, N-(p-octadecylphenyl)-p-hydroxycinnamamide, N-(o-octylphenyl)-p-hydroxycinnamamide, N-(o-tetradecylphenyl)p-hydroxycinnamamide, N-(m-octadecylphenyl)-p-hydroxycinnamamide, N-(m-octadecylphenyl)-m-hydroxycinnamamide, N-(p-tetradecylphenyl)-3,4-dihydroxycinnamamide, N-(p-dodecylphenyl)-p-hydroxy-$\beta$-methylcinnamamide, N-(p-octadecylphenyl)-p-hydroxy-$\alpha$-methylcinnamamide, N-(p-hexyloxyphenyl)-p-hydroxycinnamamide, N-(p-cyclohexyloxyphenyl)-p-hydroxycinnamamide, N-(p-dodecyloxyphenyl)-p-hydroxycinnamamide, N-{p-(2-decenyl)oxyphenyl}-p-hydroxycinnamamide, N-(p-octadecyloxyphenyl)-p-hydroxycinnamamide, N-(o-octyloxyphenyl)-p-hydroxycinnamamide, N-(m-dodecyloxyphenyl)-p-hydroxycinnamamiide, N-(m-octadecyloxyphenyl)-p-hydroxycinnamamide, N-(m-octadecyloxyphenyl)-m-hydroxycinnamamide, N-(p-tetradecyloxyphenyl)-3,4-dihydroxycinnamamide, N-(p-dodecyloxyphenyl)-p-hydroxy-$\beta$-methylcinnamamide, N-(p-octadecyloxyphenyl)-p-hydroxy-$\alpha$-methylcinnamamide, N-(p-hexylthiophenyl)-p-hydroxycinnamamide, N-(p-cylohexylthiophenyl)-p-hydroxycinnamamide, N-(p-dodecylthiophenyl)-p-hydroxycinnamamide, N{p-(2-decenyl)thiophenyl}-p-hydroxycinnamamide, N-(p-octadecylthiophenyl)-p-hydroxycinnamamide, N-(o-octylthiophenyl)-p-hydroxycinnamamide, N-(m-dodecylthiophenyl)-p-hydroxycinnamamide, N-(m-octadecylthiophenyl)-p-hydroxycinnamamide, N-(m-octadecylthiophenyl)-m-hydroxycinnamamide, N-(p-tetradecylthiophenyl)-3,4-dihydroxycinnamamide, N-(p-dodecylthiophenyl)-p-hydroxy-$\beta$-methylcinnamamide, N-(p-octadecylthiophenyl)-p-hydroxy-α-methylcinnamamide, N-(p-hexylcarbonylphenyl)-p-hydroxycinnamamide, N-(p-dodecylcarbonylphenyl)-p-hydroxycinnamamide, N-(p-octadecylcarbonylphenyl)-p-hydroxycinnamamide, N-(o-octylcarbonylphenyl)-p-hydroxycinnamamide, N-(m-dodecylcarbonylphenyl)-p-hydroxycinnamamide, N-(m-octadecylcarbonylphenyl)-p-hydroxycinnamamide, N-(m-octadecylcarbonylphenyl)-m-hydroxycinnamamide, N-(p-tetradecylcarbonylphenyl)-3,4-dihydroxycinnamamide, N-(p-dodecylcarbonylphenyl)-p-hydroxy-β-methylcinnamamide, N-(p-octadecylcarbonylphenyl)-p-hydroxy-α-methylcinnamamide, N-(p-hexylaminophenyl)-p-hydroxycinnamamide, N-(p-dicyclohexylaminophenyl)-p-hydroxycinnamamide, N-(p-dodecylaminophenyl)-p-hydroxycinnamamide, N-(p-octadecylaminophenyl)-p-hydroxycinnamamide, N-(o-octylaminophenyl)-p-hydroxycinnamamide, N-(o-tetradecylaminophenyl)-p-hydroxycinnamamide, N-(m-octadecylaminophenyl)-p-hydroxycinnamamide, N-(m-octadecylaminophenyl)-m-hydroxycinnamamide, N-(p-tetradecylaminophenyl)-3,4-dihydroxycinnamamide, N-(p-dodecylaminophenyl)-p-hydroxy-β-methylcinnamamide, N-(p-octadecylaminophenyl)-p-hydroxy-α-methylcinnamamide, N-(p-hexylsulfinylphenyl)-p-hydroxycinnamamide, N-(p-dodecylsulfinylphenyl)-p-hydroxycinnamamide, N-{p-(2-decenyl)sulfinylphenyl}-p-hydroxycinnamamide, N-(p-octadecylsulfinylphenyl)-p-hydroxycinnamamide, N-(o-octylsulfinylphenyl)-p-hydroxycinnamamide, N-(o-tetradecylsulfinylphenyl)-p-hydroxycinnamamide, N-(m-octadecylsulfinylphenyl)-p-hydroxycinnamamide, N-(m-octadecylsulfinylphenyl)-m-hydroxycinnamamide, N-(p-tetradecylsulfinylphenyl)-3,4-dihydroxycinnamamide, N-(p-dodecylsulfinylphenyl)-p-hydroxy-β-methylcinnamamide, N-(p-octadecylsulfinylphenyl)-p-hydroxy-α-methylcinnamamide, N-(p-hexylsulfonylphenyl)-p-hydroxycinnamamide, N-(p-dodecylsulfonylphenyl)-p-hydroxycinnamamide, N-{p-(2-decenyl)sulfonylphenyl}-p-hydroxycinnamamide, N-(p-octadecylsulfonylphenyl)-p-hydroxycinnamamide, N-(o-octylsulfonylphenyl)-p-hydroxycinnamamide, N-(o-tetradecylsulfonylphenyl)-p-hydroxycinnamamide, N-(m-octadecylsulfonylphenyl)-p-hydroxycinnamamide, N-(m-octadecylsulfonylphenyl)-m-hydroxycinnamamide, N-(p-tetradecylsulfonylphenyl)-3,4-dihydroxycinnamamide, N-(p-dodecylsulfonylphenyl)-p-hydroxy-β-methylcinnamamide and N-(p-octadecylsulfonylphenyl)-p-hydroxy-α-methylcinnamamide.

The electron accepting compounds of the present invention can be prepared by known processes. However, many of them are low in solvent solubility at room temperature because they have in their structure a large aliphatic chain (hydrophobic group) and a phenolic hydroxy group (polar group). Therefore, many of them are preferably prepared by carrying out the reaction under heating.

Preparation examples of some of the specific compounds are shown below, but the present invention is never limited thereto.

Preparation Example 1: Preparation of 4'-hydroxy-n-heptadecananilide (Example 3)

Under a nitrogen atmosphere, p-aminophenol (109 g) was suspended in methyl ethyl ketone (2000 ml) and the suspension was heated to 70° C. Heptadecanoyl chloride (152 g) was added to the suspension with vigorous stirring, followed by refluxing with heating for 2 hours. A 5% aqueous hydrochloric acid solution (500 ml) was added to the resulting reaction mixture with vigorous stirring. The reaction mixture was cooled to room temperature to precipitate a white crystal. This crystal was filtered off under reduced pressure and recrystallized from methyl ethyl ketone to obtain 150 g of the desired product. Yield 80%; m.p. 137° C.

Preparation Example 2: Preparation of 4'-hydroxy-n-nonadecananilide (Example 4)

Under a nitrogen atmosphere, p-aminophenol (109 g) was suspended in methyl ethyl ketone (2000 ml). To this suspension was added triethylamine (253 g) and then was added nonadecanoyl chloride (331 g), followed by refluxing with heating for 2 hours. The reaction mixture was cooled to room temperature to precipitate a white crystal. This crystal was filtered off under reduced pressure and recrystallized from methyl ethyl ketone to obtain 323 g of the desired product. Yield 80%; m.p. 138° C.

Preparation Example 3: Preparation of 4'-hydroxy-4-n-octadecyloxybenzanilide (Example 12)

Under a nitrogen atmosphere, 4-n-octadecyloxybenzoic acid (100.0 g) and dimethylformamide (5ml) were suspended in chloroform (800 ml) and thereto was added dropwise thionyl chloride (33.4 g). After completion of the addition, the suspension was refluxed with heating for 1 hour to prepare the corresponding acid chloride. The reaction mixture was cooled and thereto were added p-aminophenol (30.8 g) and triethylamine (28.6 g), followed by refluxing with heating for 2 hours. The reaction mixture was cooled to room temperature to precipitate a white crystal. This crystal was filtered off under reduced pressure and washed with distilled water and then recrystallized from isopropanol to obtain 98.7 g of the desired product. Yield 80%; m.p. 193° C.

Preparation Example 4: Preparation of N-n-octadecyl-4-hydroxybenzamide (Example 17)

Under a nitrogen atmosphere, 4-acetoxybenzoic acid (100.0 g) and N,N-dimethylformamide (3 ml) were suspended in chloroform (500 ml) and thereto was added dropwise thionyl chloride (79.2 g) for a period of about 30 minutes. After completion of the addition, the suspension was refluxed with heating for 1 hour to prepare the corresponding acid chloride. The reaction mixture was cooled and thereto were added n-octadecylamine (149.6 g) and triethylamine (67.4 g), followed by refluxing with heating for 3 hours. The reaction mixture was cooled to room temperature to precipitate a white crystal. This crystal was filtered off under reduced pressure and washed with distilled water and then recrystallized from isopropanol to obtain N-n-octadecyl-4-acetoxybenzamide (206.0 g). Yield 86%; m.p. 106° C. This was suspended in 1,4-dioxane (1000 ml) and thereto was added aqueous KOH solution 50%) (160.7 g). The reaction mixture was kept at 40°–45° C. and the reaction was allowed to proceed for 24 hours. After completion of the reaction, the reaction mixture was cooled to room temperature and thereto was added dilute hydrochloric acid to precipitate a white crystal, which was filtered off under reduced pressure. This crystal was washed with distilled water and recrystallized from chloroform to obtain the desired product (137.6 g). Yield 74%; m.p. 105° C.

Preparation Example 5: Preparation of 4-hydroxy-4'-n-octadecyloxybenzanilide (Example 18)

Under a nitrogen atmosphere, 4-acetoxybenzoic acid (100.0 g) and N,N-dimethylformamide (3 ml) were suspended in chloroform (800 ml) and thereto was added dropwise thionyl chloride (79.2 g) over a period of about 30 minutes. After completion of the addition, the suspension was refluxed with heating for 1 hour to prepare the corresponding acid chloride. The reaction mixture was cooled and thereto were added n-octadecyloxybenzaniline (200.0 g) and triethylamine (67.4 g), followed by refluxing with heating for 3 hours. The reaction mixture was cooled to room temperature to precipitate a white crystal, which was filtered off under reduced pressure. The crystal was washed with distilled water and then recrystallized from isopropanol to obtain 4-acetoxy-4'-n-octadecyloxybenzanilide (255.8 g). Yield 88%; m.p. 154° C. This was suspended in 1,4-dioxane (1000 ml) and thereto was added aqueous KOH solution (50%) (164.4 g). The reaction mixture was kept at 40°–45° C. and the reaction was allowed to proceed for 24 hours. After completion of the reaction, the reaction mixture was cooled to room temperature and thereto was added dilute hydrochloric acid to precipitate a white crystal, which was filtered off under reduced pressure. This crystal was washed with distilled water and recrystallized from chloroform to obtain the desired product (164.4 g). Yield 72%; m.p. 170° C.

Preparation Example 6: Preparation of 4-hydroxy-3', 4'-di-n-decyloxybenzanilide (Example 21)

Under a nitrogen atmosphere, 4-acetoxybenzoic acid (100.0 g) and N,N-dimethylformamide (3 ml) were suspended in chloroform (800 ml) and thereto was added dropwise thionyl chloride (79.2 g) over a period of about 30 minutes. After Completion of the addition, the suspension was refluxed with heating for 1 hour to prepare the corresponding acid chloride. The reaction mixture was cooled and thereto were added 3', 4'-di-n-decyloxybenzaniline (225.1 g) and triethylamine (67.4 g), followed by refluxing with heating for 3 hours. The reaction mixture was cooled to room temperature to precipitate a white crystal, which was filtered off under reduced pressure. The crystal was washed with distilled water and then recrystallized from isopropanol to obtain 4-acetoxy-3', 4'-di-n-decyloxybenzanilide (280.5 g). Yield 89%; m.p. 117° C. This was suspended in 1,4-dioxane (1000 ml) and thereto was added aqueous KOH solution (50%) (166.31 g). The reaction mixture was kept at 40°–45° C. and the reaction was allowed to proceed for 24 hours. After completion of the reaction, the reaction mixture was cooled to room temperature and thereto was added dilute hydrochloric acid to precipitate a white crystal, which was filtered off under reduced pressure. This crystal was washed with distilled water and recrystallized from chloroform to obtain the desired product (215.6 g). Yield 83%; m.p. 137° C.

Preparation Example 7: Preparation of 4-hydroxy-3', 4'-di-n-octadecyloxybenzanilide (Example 22)

Under a nitrogen atmosphere, 4-acetoxybenzoic acid (100.0 g) and N,N-dimethylformamide (3 ml) were suspended in chloroform (800 ml) and thereto was added dropwise thionyl chloride (79.2 g) over a period of about 30 minutes. After completion of the addition, the suspension was refluxed with heating for 1 hour to prepare the corresponding acid chloride. The reaction mixture was cooled and thereto were added 3', 4'-di-n-octadecyloxybenzaniline (349.7 g) and triethylamine (67.4 g), followed by refluxing with heating for 3 hours. The reaction mixture was cooled to room temperature to precipitate a white crystal, which was filtered off under reduced pressure. The crystal was washed with distilled water and then recrystallized from isopropanol to obtain 4-acetoxy-3', 4'-di-n-octadecyloxybenzanilide (351.7 g). Yield 80%; m.p. 107° C. This was suspended in 1,4-dioxane (1000 ml) and thereto was added aqueous KOH solution (50%) (149.5 g). The reaction mixture was kept at 40°–45° C. and the reaction was allowed to proceed for 24 hours. After completion of the reaction, the reaction mixture was cooled to room temperature and thereto was added dilute hydrochloric acid to precipitate a white crystal, which was filtered off under reduced pressure. This crystal was washed with distilled water and recrystallized from chloroform to obtain the desired product (277.5 g). Yield 82%; m.p. 133° C.

Preparation Example 8: Preparation of 4-(N-octadecylsulfonylamino)phenol (Example 25)

Under a nitrogen atmosphere, sodium octadecanesulfonate (357 g) was suspended in dimethylformamide (600 ml) and thereto was added dropwise thionyl chloride (119 g) over a period of about 30 minutes. After completion of the addition, the suspension was heated at 80° C. for 1 hour to prepare the corresponding sulfonic acid chloride. The reaction mixture was cooled and thereto were added p-aminophenol (109 g) and triethylamine (202 g), followed by refluxing with heating for 3 hours. After completion of the reaction, the reaction mixture was poured into water to precipitate a white solid. Thereto was added 5% hydrochloric acid to adjust the pH to acidic state and then, the white solid was filtered off under reduced pressure and then recrystallized from methyl ethyl ketone to obtain the desired product (302 g). Yield 71%; m.p. 142° C.

Preparation Example 9: Preparation of 1-(4-hydroxyphenylthio)-n-octadecane (Example 31)

Under a nitrogen atmosphere, p-hydroxythiophenol (126 g) was dissolved in N,N-dimethylformamide (600 ml) and thereto was added potassium carbonate (152 g). Thereto was added octadecyl chloride (318 g), followed by heating at 80° C. for 2 hours. After completion of the reaction, the reaction mixture was poured into water to precipitate a white solid. Thereto was added 5% hydrochloric acid to adjust the pH to acidic state and then, the white solid was filtered off under reduced pressure and then recrystallized from methyl ethyl ketone to obtain the desired product (261 g). Yield 70%; m.p. 95° C.

Preparation Example 10: Preparation of 4'-hydroxy-4-n-octadecyloxydiphenyl sulfide (Example 39)

Under a nitrogen atmosphere,4,4'-dihydroxydiphenyl sulfide (100.0 g), n-octadecyl bromide (179.0 g) and potassium carbonate (89.0 g) were added to dimethylformamide (1000 ml ) and the reaction mixture was kept at 90°–100° C. to allow the reaction to proceed for 3 hours. After completion of the reaction, the reaction mixture was poured into ice water to precipitate a white crystal, which was filtered off under reduced pressure.

This crystal was washed with distilled water and then recrystallized from isopropanol. The crystallized bisalkyl compound was filtered off. The filtrate was concentrated and the residue was suspended in n-hexane and heated and filtered under heating. The filtrate was concentrated to obtain the desired product (70.8 g). Yield 28%; m.p. 81° C.

Preparation Example 11: Preparation of 4'-hydroxy-4-n-heptadecylcarbonylaminodiphenyl sulfide (Example 40)

Under a nitrogen atmosphere, stearic acid (100.0 g) and dimethylformamide (3 ml) were suspended in chloroform (500 ml) and thereto was added dropwise thionyl chloride (50.2 g) over a period of about 30 minutes. After completion of the addition, the suspension was refluxed with heating for 1 hour to prepare the corresponding acid chloride. 4'-Hydroxy-4-n-aminodiphenyl sulfide (76.4 g) and triethylamine (42.4 g) were suspended in chloroform (500 ml) in a nitrogen atmosphere. To the suspension under vigorous stirring was added the above-obtained acid chloride cooled, followed by refluxing with heating for 3 hours. The reaction mixture was cooled to room temperature to precipitate a white crystal, which was filtered off under reduced pressure. This crystal was washed with distilled water and then recrystallized from isopropanol to obtain the desired product (122.4 g). Yield 72%; m.p. 143° C.

Preparation Example 12 : Preparation of N-(4-hydroxyphenyl)-N'-n-octadecylurea (Example 44)

Under a nitrogen atmosphere, p-aminophenol (109 g) was suspended in methyl ethyl ketone (2000 ml) and the suspension was heated to 70° C. n-Octadecyl isocyanate (296 g) was added dropwise to the suspension with vigorous stirring over a period of about 30 minutes. In this case, since heat of reaction was generated, n-octadecyl isocyanate was added dropwise at a rate at which the temperature of the reaction mixture was kept at 70°–75° C. After completion of the addition, the temperature of the reaction mixture was raised to 75°–80° C. and the reaction was allowed to proceed for further 30 minutes. After completion of the reaction, the reaction mixture was tooled to room temperature to precipitate a white solid. The solvent was removed by filtration and the residue was dried under reduced pressure to obtain a nearly pure desired product (385 g). Yield 95%; m.p. 144° C.

Preparation Example 13: Preparation of N-(4-hydroxybenzylidene)-n-octadecylamine (Example 49)

Under a nitrogen atmosphere, p-hydroxybenzaldehyde (99.6 g), n-octadecylamine (200.0 g) and p-toluenesulfonic acid (13.4 g) were added to toluene (1200 ml) and the mixture was refluxed with heating and simultaneously the azeotropic water was removed. After about 2 hours, the reaction mixture was cooled to room temperature to precipitate a crystal, which was filtered off under reduced pressure. This crystal was recrystallized from isopropanol to obtain the desired product (207.9 g). Yield 75%; m.p. 101° C.

Preparation Example 14: Preparation of N-(4-hydroxybenzylidene)-n-octadecyloxyaniline (Example 51)

Under a nitrogen atmosphere, p-hydroxybenzaldehyde (99.6 g), n-octadecylaniline (250.0 g) and p-toluenesulfonic acid (12.5 g) were added to toluene (2000 ml) and the mixture was refluxed with heating and simultaneously the azeotropic water was removed. After about 3 hours, the reaction mixture was cooled to room temperature to precipitate a crystal, which was filtered off under reduced pressure. This crystal was recrystallized from isopropanol to obtain the desired product (225.4 g). Yield 70%; m.p. 125° C.

Preparation Example 15: Preparation of N-(4'-n-octadecyloxy)benzylidene-4-hydroxyaniline (Example 54)

Under a nitrogen atmosphere, p-octadecyloxybenzaldehyde (100.0 g), p-aminophenol (32.0 g) and p-toluenesulfonic acid (4.8 g) were added to toluene (1000 ml) and the mixture was refluxed with heating and simultaneously the azeotropic water was removed. After about 2 hours, the reaction mixture was cooled to room temperature to precipitate a crystal, which was filtered off under reduced pressure. This crystal was recrystallized from isopropanol to obtain the desired product (101.9 g). Yield 82%; m.p. 115° C.

Preparation Example 16: Preparation of N-octadecyl-p-hydroxycinnamamide (Example 56)

Under a nitrogen atmosphere, 4-acetoxycinnamic acid (150 g) and N,N-dimethylformamide (5 ml) were suspended in chloroform (800 ml) and thereto was added dropwise thionyl chloride (104 g) over a period of about 30 minutes. After completion of the addition, the reaction mixture was reflexed with heating for 1 hour to prepare the corresponding acid chloride. The reaction mixture was cooled to room temperature and thereto was added dropwise a solution of octadecylamine (196 g) and triethylamine (81 g) in chloroform (50 ml) over a period of about 30 minutes, followed by refluxing with heating for 3 hours. The reaction mixture was cooled to room temperature to precipitate a white crystal, which was filtered off under reduced pressure and dried to obtain N-octadecyl-p-acetoxycinnamamide (258 g). Yield 78%. This was suspended in 1,4-dioxane (1200 ml) and thereto was added aqueous KOH solution 50%; 127 g) and the reaction was allowed to proceed at 40°–45° C. for 24 hours. After completion of the reaction, the reaction mixture was cooled to room temperature to precipitate a white crystal, which was filtered off under reduced pressure. This crystal was washed with distilled water and recrystallized from methanol to obtain the desired product (211 g). Yield 90%; m.p. 114° C.

The electron accepting compounds in the present invention may be used each alone or in combination of two or more. The amount of the electron accepting compound is 5–5000% by weight, preferably 10–3000% by weight based on the normally colorless or slightly colored dye precursor.

Representatives of the normally colorless or slightly colored electron donating dye precursor used in the present invention are those which are generally used for pressure-sensitive recording paper, heat-sensitive recording paper, photo-sensitive pressure-sensitive paper, electro heat-sensitive recording paper, heat-sensitive transfer paper and the like and they are unlimited. Non-limiting typical examples of the dye precursors are enumerated below.

(1) Triarylmethane compounds:

3,3-Bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide and 3-p-dimethylaminophenyl-3-(1-methylpyrol-2-yl)-6-dimethylaminophthalide.

(2) Diphenylmethane compounds:

4,4'-Bis(dimethylaminophenyl)benzhydrylbenzyl ether, N-chlorophenylleucoauramine and N-2,4,5-trichlorophenylleucoauramine.

(3) Xanthene compounds:

Rhodamine B anilinolactam, rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroaniline)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenetylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran and 3-(N-ethyl-N-tetrahydrofuryl)amino-6-methyl-7-anilinofluoran.

(4) Thiazine compounds:

Benzoylleucomethylene blue and p-nitrobenzoylleucomethylene blue.

(5) Spiro compounds:

3-Methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran and 3-propylspirobenzopyran.

The normally colorless or slightly colored electron donating dye precursors may be used each alone or in combination of two or more.

A specific method for producing the reversible heat-sensitive recording material of the present invention is mentioned below, but the present invention is not limited thereto.

As an example of a method for producing the reversible heat-sensitive recording material of the present invention, mention may be made of one which comprises forming a reversible heat-sensitive recording layer by coating on a support the normally colorless or palely colored electron donating dye precursor and the electron accepting compound of the present invention as main components.

For containing the normally colorless or slightly colored electron donating dye precursor and the electron accepting compound of the present invention in the reversible heat-sensitive layer, there are the following methods: Each of the compounds is dissolved in a solvent or dispersed in a dispersion medium and then the solutions or dispersions are mixed; The compounds are mixed and the mixture is dissolved in a solvent or dispersed in a dispersion medium; The compounds are heated and dissolved to homogenize them, then cooled and dissolved in a solvent or dispersed in a dispersion medium. These are not limitative.

Furthermore, binders can be added to the reversible heat-sensitive recording layer for improving the strength of the layer, Examples of the binders are water-soluble polymers such as starches, hydroxyethylcellulose, methylcellulose, carboxymethylcellulose, gelatin, casein, polyvinyl alcohol, modified polyvinyl alcohol, sodium polyacrylate, acrylamide/acrylate copolymer, acrylamide/acrylate/methacrylic acid terpolymer, alkali salts of styrene/maleic anhydride copolymer and alkali salts of ethylene/maleic anhydride copolymer and latexes such as polyvinyl acetate, polyurethane, polyacrylates, styrene/butadiene copolymer, acrylonitrile/butadiene copolymer, methyl acrylate/butadiene copolymer and ethylene/vinyl acetate copolymer.

Furthermore, a heat meltable substance can be contained in the reversibile heat-sensitive recording layer as an additive for adjusting the color formation sensitivity and decolonizing temperature. The heat meltable substances used in the present invention are those which have a melting point of preferably 60°–200° C., more preferably 80°–180° C. In addition, sensitizers used for general heat-sensitive recording paper can also be used. Examples of the heat meltable substances are waxes such as N-hydroxymethylstearamide, stearamide and palmitamide, naphthol derivatives such as 2-benzyloxynaphthalene, biphenyl derivatives such as p-benzylbiphenyl and 4-allyloxybiphenyl, polyether compounds such as 1,2-bis(3-methylphenoxy)ethane, 2,2'-bis(4-methoxyphenoxy)diethyl ether and bis(4-methoxyphenyl) ether and carbonic acid or oxalic acid diester derivatives such as diphenyl carbonate, dibenzyl oxalate and bis(p-methylbenzyl) oxalate. These may be used each alone or in combination of two or more.

As the support for the reversible heat-sensitive recording materials of the present invention, there may be optionally used paper, various nonwoven fabrics, woven fabrics, synthetic resin films, synthetic resin laminated papers, synthetic papers, metallic foils, glasses and composite sheets comprising the combination of them. These are not limitative.

The layer structure of the reversible heat-sensitive recording material of the present invention may comprise only the reversible heat-sensitive recording layer. If necessary,l a protective layer may be provided on the reversible heat-sensitive recording layer or an intermediate layer may be provided between the reversible heat-sensitive recording layer and the support. In this case, the protective layer and/or the intermediate layer may comprise a plurality of two or more layers. Furthermore, a material which can electrically, magnetically or optically record the information may be contained in the reversible heat-sensitive recording layer and/or other layers and/or on the side on which the reversible heat-sensitive recording layer is provided or the reverse side thereof. Moreover, a backcoat layer may be provided on the side reverse to the side on which the reversible heat-sensitive layer is provided, for curling inhibition and antistatic purposes.

The reversible heat-sensitive recording layer can be formed, for example, by a method of mixing the dispersions obtained by milling the respective color forming components, coating the mixture on a support and drying the coat and by a method of mixing the solutions obtained by dissolving the respective color forming components in solvents, coating the mixture on a support and drying the coat. In this case, the layer may comprise multilayers each of which contains each of the color forming components.

The reversible heat-sensitive recording layer and/or the protective layer and/or the intermediate layer may further contain pigments such as diatomaceous earth, talc, kaolin, calcined kaolin, calcium carbonate, magnesium carbonate, titanium oxide, zinc oxide, silicon oxide, aluminum hydroxide and urea-formalin resin, and besides, metallic salts of higher fatty acids such as zinc stearate and calcium stearate and waxes such as paraffin, paraffin oxide, polyethylene, polyethylene oxide, stearamide and castor wax for inhibition of wearing of heads and inhibition of sticking, and furthermore, dispersants such as sodium dioctylsulfosuccinate, surfactants and fluorescent dyes.

The principle of formation and erosion of the images in the reversible heat-sensitive recording materials of the present invention is considered as follows. When the normally colorless or slightly colored electron donating dye precursor used in the present invention is heated together with the electron accepting compound such as a phenolic compound, transfer of the electrons from the electron donating dye precursor to the electron accepting compound occurs to form a color. It is considered that at that time the molecules of the electron accepting compound are present near the dye molecules which have formed the color. When the molecules of the electron accepting compound are separated from the dye molecules which have formed the color, the dye molecules which have formed the color again accept the electrons and are restored to the state of the electron donating dye precursor before the formation of color. It is considered that according to the present invention, the distance between the molecule of the electron accepting compound and the molecule of the electron donating dye precursor (dye molecule) is changed by heating them, thereby to carry out color formation and decolorization.

In more detail, since the electron accepting compound of the present invention has a large aliphatic chain in its structure, the compatibility with the molecule of the electron donating dye precursor and the dye molecule which has formed a color is very low. Therefore, in the molten state where the molecules can move freely, the molecules of the electron donating dye precursor and the molecules of the electron accepting compound dissolve with each other at a certain ratio, resulting in a color-formed state, but when the mixture in molten state which has formed a color is slowly cooled, with lowering of the temperature it solidifies with bringing about the phase separation to cause decolorization. On the other hand, when rapid cooling (rapid solidification) is carried out, the solidification occurs before occurrence of the phase separation, namely, keeping the color-formed state. That is, in the reversible heat-sensitive recording material of the present invention, the color-formed state and the decolorized state are developed by producing the mutually dissolved state and the phase separation state of the electron donating dye precursor and the electron accepting compound by the difference in cooling rate after heating.

The color formation of the reversible heat-sensitive recording material of the present invention can be brought about when a rapid cooling occurs subsequent to the heating and the decolorization can occur when the cooling rate after the heating is slow. For example, when the recording materialism heated for a relatively long time by a suitable heat source (thermal head, laser beam, hot roll, hot stamping, high-frequency heating, radiant heat from electrical heater, hot air or the like), since not only the recording layer, but also the support are heated, the cooling rate becomes slow to result in phase separation state (decolorized state). On the other hand, the color-formed state can be produced by a rapid cooling, for example, with application of a metal block of low temperature after the heating conducted by a suitable means. Furthermore, when the heating is carried out for only a very short time by a thermal head, a laser beam or the like, the cooling (solidification) begins immediately after termination of the heating and thus the color-formed state can be produced. Accordingly, even when the same heating temperature and/or the same heat source is used, the color-formed state and the decolorized state can be optionally produced by controlling the cooling rate.

The following examples illustrate the present invention.

EXAMPLE 1

(A) Preparation of a reversible heat-sensitive coating color:

40 parts of 3-di-n-butylamino-6-methyl-7-anilinofluoran which was a dye precursor was milled together with 90 parts of 2.5% aqueous polyvinyl alcohol solution in a ball mill for 24 hours to obtain a dye precursor dispersion. Then, 100 parts of 4'-hydroxy-n-heptananilide was milled together with 400 parts of 2.5% aqueous polyvinyl alcohol solution in a ball mill for 24 hours to obtain a dispersion.

These two dispersions were mixed and then 200 parts of 10% aqueous polyvinyl alcohol solution and 400 parts of water were added to the mixture and well mixed to prepare a reversible heat-sensitive coating color.

(B) Preparation of a reversible heat-sensitive recording material:

The reversible heat-sensitive coating color prepared in the above (A) was coated on a polyethylene terephthalate (PET) sheet at a coating weight (solid matter) of 4 $g/m^2$ and dried. Then, the coated sheet was subjected to supercalendering to obtain a reversible heat-sensitive recording material.

EXAMPLE 2–55

Reversible heat-sensitive recording materials were prepared in the same manner as in Example 1 except that a dispersion obtained by milling 100 parts of each of the following compounds together with 400 parts of 2.5% aqueous polyvinyl alcohol solution in a ball mill for 24 hours was used in place of the dispersion of 4'-hydroxy-n-heptananilide.

(Example 2): 4'-hydroxy-n-tridecananilide
(Example 3): 4'-hydroxy-n-heptadecananilide
(Example 4): 4'-hydroxy-n-nonadecananilide
(Example 5): 3'-hydroxy-n-nonadecananilide
(Example 6): 4'-hydroxy-10-n-octadecenanilide
(Example 7): 4'-hydroxy-n-docosananilide
(Example 8): 4'-hydroxy-4-n-hexylbenzanilide
(Example 9): 4'-hydroxy-4-n-dodecylbenzanilide
(Example 10): 4'-hydroxy-4-n-tetradecyloxybenzanilide
(Example 11): 4'-hydroxy-4-n-octadecylbenzanilide
(Example 12): 4'-hydroxy-4-n-octadecyloxybenzanilide (Example 13); 4'-hydroxy-4-n-octadecylcarbonylaminobenzanilide
(Example 14): 4'-hydroxy-3-n-octadecylcarbonylamino-5-n-octadecyloxybenzanilide
(Example 15): N-n-octyl-4-hydroxybenzamide
(Example 16): N-n-dodecyl-4-hydroxybenzamide
(Example 17): N-n-octadecyl-4-hydroxybenzamide
(Example 18): 4-hydroxy-4'-n-octadecyloxybenzanilide
(Example 19): 4-hydroxy-4'-n-dodecylbenzanilide
(Example 20): 4-hydroxy-4'-n-tetradecylbenzanilide
(Example 21): 4-hydroxy-3', 4'-di-n-decyloxybenzanilide
(Example 22): 4-hydroxy-3', 4'-di-n-octadecyloxybenzanilide
(Example 23): 4-(N-n-octylsulfonylamino)phenol
(Example 24): 4-(N-n-dodecylsulfonylamino)phenol
(Example 25): 4-(N-n-octadecylsulfonylamino)phenol
(Example 26): 4'-hydroxy-4-n-dodecylbenzenesulfonanilide
(Example 27): 4'-hydroxy-4-n-dodecyloxybenzenesulfonanilide
(Example 28): 4'-hydroxy-4-n-octadecyloxybenzenesulfonanilide
(Example 29): 1-(4-hydroxyphenylthio)-n-hexane
(Example 30): 1-(4-hydroxyphenylthio)-n-dodecane
(Example 31): 1-(4-hydroxyphenylthio)-n-octadecane
(Example 32): 1-(3-hydroxyphenylthio)-n-octadecane
(Example 33): 1-(4-hydroxyphenylthio)-9-n-octadecene
(Example 34): 1-(4-hydroxyphenylthio)-n-docosane
(Example 35): 4'-hydroxy-4-n-hexyldiphenyl sulfide
(Example 36): 4'-hydroxy-4-n-dodecyldiphenyl sulfide
(Example 37): 4'-hydroxy-4-n-tetradecyloxydiphenyl sulfide
(Example 38): 4'-hydroxy-4-n-octadecyldiphenyl sulfide
(Example 39): 4'-hydroxy-4-n-octadecyloxydiphenyl sulfide
(Example 40): 4'-hydroxy-4-n-octadecylcarbonylaminodiphenyl sulfide
(Example 41): 4'-hydroxy-3,4-di-n-decyloxydiphenyl sulfide
(Example 42): N-(4-hydroxyphenyl)-N'-n-hexylurea
(Example 43): N-(4-hydroxyphenyl)-N'-n-dodecylurea
(Example 44): N-(4-hydroxyphenyl)-N'-n-octadecylurea
(Example 45): N-(3-hydroxyphenyl)-N'-n-octadecylurea
(Example 46): N-(4-hydroxyphenyl)-N'-(9-n-octadecenyl)urea
(Example 47): N-(4-hydroxyphenyl)-N'-n-docosylurea
(Example 48): N-(4-hydroxybenzylidene)-n-decylamine
(Example 49): N-(4-hydroxybenzylidene)-n-octadecylamine
(Example 50): N-(4-hydroxybenzylidene)-4-n-tetradecylaniline
(Example 51): N-(4-hydroxybenzylidene)-4-n-octadecyloxyaniline
(Example 52): N-n-tetradecylidene-4-hydroxyaniline
(Example 53): N-(4'-n-tetradecyl)benzylidene-4-hydroxyaniline
(Example 54): N-(4'-n-octadecyloxy)benzylidene-4-hydroxyaniline
(Example 55): N-(4'-n-octadecylthio)benzylidene-4-hydroxyaniline Comparative Example 1

Example 1 was repeated except that a dispersion obtained by milling 100 parts of a salt of garlic acid and stearylamine together with 400 parts of 2.5% aqueous polyvinyl alcohol solution in a ball mill for 24 hours was used in place of the dispersion of 4'-hydroxy-n-heptananilide.

Comparative Example 2

Example 1 was repeated except that a dispersion obtained by milling 100 parts of 2,2-bis(4-hydroxyphenyl)propane together with 400 parts of 2.5% aqueous polyvinyl alcohol solution in a ball mill for 24 hours was used in place of the dispersion of 4'-hydroxy-n-heptananilide.

Comparative Example 3

Example 1 was repeated except that a dispersion obtained by milling 100 parts of benzyl 4-hydroxybenzoate together with 400 parts of 2.5% aqueous polyvinyl alcohol solution in a ball mill for 24 hours was used in place of the dispersion of 4'-hydroxy-n-heptananilide.

Test 1 (Color density=heat response)

The heat-sensitive recording materials obtained in Examples 1–55 and Comparative Examples 1–3 were subjected to printing under the conditions of an applied pulse of 1.0 msec and an applied voltage of 26 volts using a heat-sensitive facsimile printing tester TH-PMD (manufactured by Okura Electric Co.) having a printing head KJT-256-8MGF1 (manufactured by Kyocera Co.) and density of the resulting color image was measured by a densitometer Macbeth RD918. The results are shown in Tables 1–6.

Test 2 (Change of color density with time=image stability)

The heat-sensitive recording materials obtained in Examples 1–55 and Comparative Examples 1–3 were subjected to printing under the conditions of an applied pulse of 1.0 msec and an applied voltage of 26 volts using a heat-sensitive facsimile printing tester TH-PMD (manufactured by Okura Electric Co.) having a printing head KJT-256-8MGF1 (manufactured by Kyocera Co.) and they were stored for 96 hours in an atmosphere of 25° C. and a relative humidity of 60%. Thereafter, the density of the color-formed portion was measured in the same manner as in the above Test 1 and image retention rate was calculated by the following formula. The results are shown in Tables 1–6.

$$A=(C/B)\times 100$$

A: Retention rate of color density (%)
B: Image density before subjected to the test
C: Image density after subjected to the test Test 3 (Erasability of image)

The heat-sensitive recording materials obtained in Examples 1–55 and Comparative Examples 1–3 were subjected to printing under the conditions of an applied pulse of 1.0 msec and an applied voltage of 26 volts using a heat-sensitive facsimile printing tester TH-PMD (manufactured by Okura Electric Co.) having a printing head KJT-256-8MGF1 (manufactured by Kyocera Co.) and were heated at 120° Cc for 1 second by a hot stamp. Thereafter, the density was measured in the same manner as in the above Test 1. The results are shown in Tables 1–6.

TABLE 1

| | Test 1 Density of color formed portion | Test 2 Retention rate of color density | Test 3 Density of decolorized portion | Contrast |
|---|---|---|---|---|
| Example 1 | 1.15 | 96% | 0.58 | Δ |
| Example 2 | 0.97 | 94% | 0.23 | ○ |
| Example 3 | 0.95 | 93% | 0.12 | ○ |
| Example 4 | 0.91 | 92% | 0.06 | ○ |
| Example 5 | 1.05 | 94% | 0.52 | Δ |
| Example 6 | 0.92 | 95% | 0.07 | ○ |
| Example 7 | 0.90 | 94% | 0.09 | ○ |
| Example 8 | 1.13 | 95% | 0.65 | Δ |
| Example 9 | 1.11 | 91% | 0.31 | ○ |
| Example 10 | 1.01 | 92% | 0.26 | ○ |

TABLE 2

| | Test 1 Density of color formed portion | Test 2 Retention rate of color density | Test 3 Density of decolorized portion | Contrast |
|---|---|---|---|---|
| Example 11 | 1.09 | 93% | 0.09 | ○ |
| Example 12 | 0.99 | 91% | 0.08 | ○ |
| Example 13 | 1.00 | 94% | 0.12 | ○ |
| Example 14 | 0.88 | 96% | 0.07 | ○ |
| Example 15 | 1.20 | 97% | 0.62 | Δ |
| Example 16 | 1.17 | 95% | 0.37 | ○ |
| Example 17 | 1.15 | 93% | 0.22 | ○ |
| Example 18 | 1.00 | 92% | 0.13 | ○ |
| Example 19 | 1.15 | 95% | 0.31 | ○ |
| Example 20 | 1.12 | 92% | 0.11 | ○ |

TABLE 3

| | Test 1 Density of color formed portion | Test 2 Retention rate of color density | Test 3 Density of decolorized portion | Contrast |
|---|---|---|---|---|
| Example 21 | 1.17 | 93% | 0.21 | ○ |
| Example 22 | 1.15 | 92% | 0.15 | ○ |
| Example 23 | 1.18 | 97% | 0.58 | Δ |
| Example 24 | 1.15 | 96% | 0.34 | ○ |
| Example 25 | 1.15 | 94% | 0.21 | ○ |
| Example 26 | 1.12 | 92% | 0.13 | ○ |
| Example 27 | 1.15 | 93% | 0.27 | ○ |
| Example 28 | 1.12 | 92% | 0.10 | ○ |
| Example 29 | 1.25 | 96% | 0.65 | Δ |
| Example 30 | 1.03 | 92% | 0.27 | ○ |

TABLE 4

| | Test 1 Density of color formed portion | Test 2 Retention rate of color density | Test 3 Density of decolorized portion | Contrast |
|---|---|---|---|---|
| Example 31 | 0.88 | 91% | 0.12 | ○ |
| Example 32 | 0.99 | 92% | 0.22 | ○ |
| Example 33 | 0.92 | 90% | 0.11 | ○ |
| Example 34 | 0.90 | 94% | 0.09 | ○ |
| Example 35 | 1.12 | 94% | 0.56 | Δ |
| Example 36 | 1.09 | 90% | 0.32 | ○ |
| Example 37 | 1.07 | 91% | 0.24 | ○ |
| Example 38 | 1.07 | 92% | 0.09 | ○ |
| Example 39 | 1.12 | 92% | 0.08 | ○ |
| Example 40 | 1.15 | 93% | 0.13 | ○ |

TABLE 5

| | Test 1 Density of color formed portion | Test 2 Retention rate of color density | Test 3 Density of decolorized portion | Contrast |
|---|---|---|---|---|
| Example 41 | 1.17 | 94% | 0.10 | ○ |
| Example 42 | 1.40 | 97% | 0.65 | Δ |
| Example 43 | 1.35 | 94% | 0.22 | ○ |
| Example 44 | 1.36 | 96% | 0.07 | ○ |
| Example 45 | 1.44 | 98% | 0.59 | Δ |
| Example 46 | 1.34 | 95% | 0.09 | ○ |
| Example 47 | 1.35 | 96% | 0.08 | ○ |
| Example 48 | 1.20 | 94% | 0.35 | ○ |
| Example 49 | 1.00 | 92% | 0.08 | Δ |
| Example 50 | 0.98 | 93% | 0.06 | ○ |

TABLE 6

| | Test 1 Density of color formed portion | Test 2 Retention rate of color density | Test 3 Density of decolorized portion | Contrast |
|---|---|---|---|---|
| Example 51 | 1.05 | 93 | 0.07 | ○ |
| Example 52 | 1.10 | 95 | 0.40 | Δ |
| Example 53 | 0.99 | 91 | 0.22 | ○ |
| Example 54 | 1.01 | 93 | 0.09 | ○ |
| Example 55 | 1.01 | 91 | 0.12 | ○ |
| Comparative Example 1 | 0.47 | 56 | 0.23 | Δ |
| Comparative Example 2 | 1.37 | 99 | 1.28 | x |
| Comparative Example 3 | 1.33 | 78 | 1.18 | x |

EXAMPLE 56

(A) Preparation of a reversible heat-sensitive coating color:

40 parts of 3-di-n-butylamino-6-methyl-7-anilinofluoran which was a dye precursor was milled together with 90 parts of 2.5% aqueous polyvinyl alcohol solution in a ball mill for 24 hours to obtain a dye precursor dispersion. Then, 100 parts of N-octadecyl-p-hydroxycinnamamide was milled together with 400 parts of 2.5% aqueous polyvinyl alcohol solution in a ball mill for 24 hours to obtain a dispersion.

These two dispersions were mixed and then 200 parts of 10% aqueous polyvinyl alcohol solution and 400 parts of water were added to the mixture and well mixed to prepare a reversible heat-sensitive coating color.

(B) Preparation of a reversible heat-sensitive recording material:.

The reversible heat-sensitive coating color prepared in the above (A) was coated on a polyethylene terephthalate (PET) sheet at a coating amount (solid matter) of 4 g/m$^2$ and dried. Then, the coated sheet was subjected to supercalendering to obtain a reversible heat-sensitive recording material.

EXAMPLES 57–59

Reversible heat-sensitive recording materials were prepared in the same manner as in Example 56 except that a dispersion obtained by milling 100 parts of each of the following compounds together with 400 parts of 2.5% aqueous polyvinyl alcohol solution in a ball mill for 24 hours was used in place of the dispersion of N-octadecyl-p-hydroxycinnamamide.

(Example 57): N-(p-tetradecylphenyl)-p-hydroxycinnamamide (Example 58): N-(p-tetradecyloxyphenyl)-p-hydroxycinnamamide (Example 59): N-(p-octadecyloxyphenyl)-p-hydroxycinnamamide The test results are shown in Table 7.

TABLE 7

| | Test 1 Density of color formed portion | Test 2 Retention rate of color density | Test 3 Density of decolorized portion | Contrast |
|---|---|---|---|---|
| Example 56 | 1.24 | 91% | 0.15 | ○ |
| Example 57 | 1.32 | 92% | 0.22 | ○ |
| Example 58 | 1.34 | 94% | 0.20 | ○ |
| Example 59 | 1.35 | 96% | 0.10 | ○ |

In the above Tables 1–7, "○" shows that the density of the decolorized portion is less than 30% of the density of the color formed portion and the contrast between the color formed portion and the decolorized portion is high, "Δ" shows that the density of the decolorized portion is 30% or more and less than 80% of the density of the color formed portion and the contrast is insufficient, and "×" shows that the density of the decolorized portion is 80% or more of the density of the color formed portion and the reversibility is not recognized.

As shown in Tables 1–7, a reversible heat-sensitive recording material which contains a normally colorless or slightly colored electron donating dye precursor and an electron accepting compound capable of causing said dye precursor to change reversibly in color density due to the difference in cooling rate after heating and in which images can be formed and erased with good contrast and images high in time stability can be maintained under environment of everyday life can be obtained by using a phenolic compound having at least one aliphatic hydrocarbon group of 6 or more carbon atoms.

What is claimed is:

1. A reversible heat-sensitive recording material which contains a normally colorless or slightly colored electron donating dye precursor and an electron accepting compound capable of causing a reversible change in color density of said dye precursor due to the difference in cooling rate after heating, said electron accepting compound being a phenolic compound having the following formula (4):

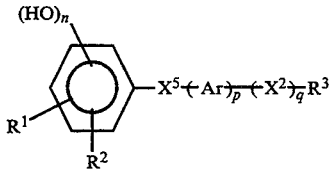

(4)

wherein n represents an integer of 1 to 3, p and q each represent 0 or 1, $R^1$ and $R^2$ each represents a hydrogen atom or a substituent selected from an aliphatic hydrocarbon group, an alkoxy group and a halogen atom and may be identical or different, $R^3$ represents an aliphatic hydrocarbon group of 6 or more carbon atoms, $X^2$ represents a divalent group having at least one hetero atom, Ar is represented by the following formula (3):

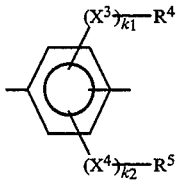

(3)

wherein $k_1$ and $k_2$ each represents an integer of 0 or 1; $X^3$ and $X^4$ each represents a divalent group having at least one hetero atom and may be identical or different; when $k_1$ is 0, $R^4$ represents a hydrogen atom or a substituent selected from an aliphatic hydrocarbon group, an alkoxy group and a halogen atom and when $k_1$ is 1, $R^4$ represents an aliphatic hydrocarbon group; and when $k_2$ is 0, $R^5$ represents a hydrogen atom or a substituent selected from an aliphatic hydrocarbon group, an alkoxy group and a halogen atom and when $k_2$ is 1, $R^5$ represents an aliphatic hydrocarbon group, $X^5$ is represented by the following formula:

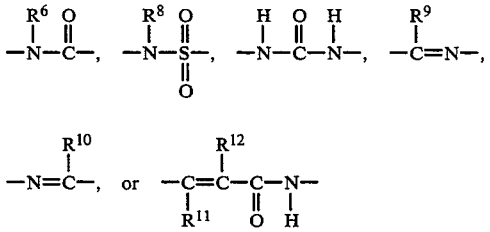

wherein $R^6$, $R^8$, $R^9$ and $R^{10}$ each represents an aliphatic hydrocarbon group or a hydrogen atom, and $R^{11}$ and $R^{12}$ each represents a lower alkyl group or a hydrogen atom.

2. A reversible heat-sensitive recording material which contains a normally colorless or slightly colored electron donating dye precursor and an electron accepting compound capable of causing a reversible change in color density of said dye precursor due to the difference in cooling rate after heating, said electron accepting compound being a phenolic compound having the following formula (6):

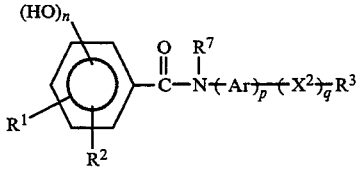

(6)

wherein n represents an integer of 1 to 3, p represents 1, q represents 0 or 1, $R^1$ and $R^2$ each represents a hydrogen atom or a substituent selected from an aliphatic hydrocarbon group, an alkoxy group and a halogen atom and may be identical or different, $R^3$ represents an aliphatic hydrocarbon group of 6 or more carbon atoms, $X^2$ represents a divalent group having at least one hetero atom, Ar is represented by the following formula (3):

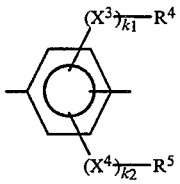

(3)

wherein $k_1$ and $k_2$ each represents an integer of 0 or 1; $X^3$ and $X^4$ each represents a divalent group having at least one hetero atom and may be identical or different; when $k_1$ is 0, $R^4$ represents a hydrogen atom or a substituent selected from an aliphatic hydrocarbon group, an alkoxy group and a halogen atom and when $k_1$ is 1, $R^4$ represents an aliphatic hydrocarbon group; and when $k_2$ is 0 , $R^5$ represents a hydrogen atom or a substituent selected from an aliphatic hydrocarbon group, an alkoxy group and a halogen atom and when $k_2$ is 1, $R^5$ represents an aliphatic hydrocarbon group, and $R^7$ represents an aliphatic hydrocarbon group or a hydrogen atom.

3. A reversible heat-sensitive recording material which contains a normally colorless or slightly colored electron donating dye precursor and an electron accepting compound capable of causing a reversible change in color density of said dye precursor due to the difference in cooling rate after heating, said electron accepting compound being a phenolic compound having the following formula (8):

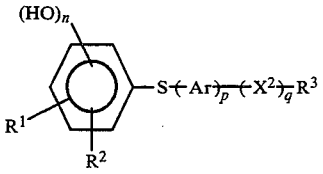

(8)

wherein n represents an integer of 1 to 3, p represents 1, q represents 0 or 1, $R^1$ and $R^2$ each represents a hydrogen atom or a substituent selected from an aliphatic hydrocarbon group, an alkoxy group and a halogen atom and may be identical or different, $R^3$ represents an aliphatic hydrocarbon group having at least 6 carbon atoms, $X^2$ represents a divalent group having at least one hetero atom, Ar is represented by the following formula (3):

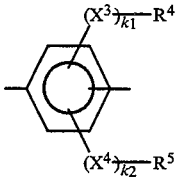

(3)

wherein $k_1$ and $k_2$ each represents an integer of 0 or 1; $X^3$ and $X^4$ each represents a divalent group having at least one hetero atom and may be identical or different; when $k_1$ is 0, $R^4$ represents a hydrogen atom or a substituent selected from an aliphatic hydrocarbon group, an alkoxy group and a halogen atom and when $k_1$ is 1, $R^4$ represents an aliphatic hydrocarbon group; and when $k_2$ is 0, $R^5$ represents a hydrogen atom or a substituent selected from an aliphatic hydrocarbon group, an alkoxy group and a halogen atom and when $k_2$ is 1, $R^5$ represents an aliphatic hydrocarbon group.

* * * * *